United States Patent [19]

Dieleman

[11] 4,053,966

[45] Oct. 18, 1977

[54] BUCKLE APPARATUS

[76] Inventor: Lawrence A. Dieleman, 2119 Tulip Lane, Jenison, Mich. 49428

[21] Appl. No.: 654,200

[22] Filed: Feb. 2, 1976

[51] Int. Cl.[2] ..... A44B 11/00

[52] U.S. Cl. ..... 24/163 R; 24/163 K

[58] Field of Search ..... 58/88 W, 88 WC, 88 G, 58/95 R, 88 R, 88 SC, 88 B, 88 C, 88 E; 224/4 A, 4 C, 4 D, 4 E, 4 F, 4 J, 4 K; 24/163 KO, 176, 186, 90 A

[56] References Cited

U.S. PATENT DOCUMENTS

| | | | |
|---|---|---|---|
| 744,933 | 11/1903 | Nicholson | 224/4 C |
| 804,493 | 11/1905 | McCarthy | 224/4 C |
| 1,600,889 | 9/1926 | Kislinger | 58/95 R X |
| 1,729,578 | 9/1929 | Gogan | 24/186 X |
| 2,099,515 | 11/1937 | Grey | 58/88 SC |
| 2,219,277 | 10/1940 | Kaufmann | 58/88 SC X |
| 2,541,432 | 2/1951 | Muehlbauer | 224/4 E |
| 2,576,476 | 11/1951 | Peter et al. | 58/88 R |
| 2,649,636 | 8/1953 | Freysinger | 24/163 KO |
| 2,804,746 | 9/1957 | Blumstein | 58/88 W |
| 2,840,875 | 7/1958 | Chambers | 24/163 KO |

FOREIGN PATENT DOCUMENTS

| | | | |
|---|---|---|---|
| 1,375,507 | 9/1964 | France | 24/90 A |
| 1,262,622 | 4/1961 | France | 58/88 E |
| 335,174 | 2/1959 | Switzerland | 58/88 SC |
| 368,650 | 5/1963 | Switzerland | 224/4 D |
| 197,208 | 5/1923 | United Kingdom | 58/88 WC |

*Primary Examiner*—Paul R. Gilliam
*Assistant Examiner*—Victor N. Sakran
*Attorney, Agent, or Firm*—Price, Heneveld, Huizenga & Cooper

[57] ABSTRACT

The specification discloses a combination decorative belt buckle and instrument housing adapted to hold and display a watch, compass or other instrument on the belt of a user. The buckle and instrument housing combination includes a base member having means on one side formed as a conventional buckle including means for securing the ends of a belt about the waist of the user. A decorative portion on the face of the buckle has an instrument receiving chamber formed therein to receive and secure the instrument. In one embodiment, the base and the decorative portion are integrally formed of the same material. In another embodiment, the base is formed of metal and decorative portion is formed of nonmetallic material as wood or the like.

18 Claims, 13 Drawing Figures

BUCKLE APPARATUS

BACKGROUND OF THE INVENTION

Buckle asemblies to secure and hold the ends of a belt around the waist of a user are well known in the art. Certain belt buckles include mechanisms for holding a watch, compass or like device on the belt of a user. Such buckle arrangements are shown, for example, in U.S. Pat. No. 1,383,968 which discloses a belt buckle having a watch hinged thereon which folds into the buckle when not in use such that the face of the watch faces inwardly toward the wearer. British Patent 318,128 discloses a watch having a spring hinged cover mounted on a belt buckle and British Patent 464,313 discloses a container having a cover which is screwed into a threaded opening in the buckle itself.

Other arrangements in the form of carrying devices attachable to a belt but not adapted to close and attach the ends of the belt are also shown, for example, in U.S. Pat. Nos. 1,961,066; 2,124,945 and in British Pat. No. 117,243. The devices shown in these patents, however, disclose attaching mechanisms for carrying watches or the like on the belt. None of these devices are particularly aesthetically pleasing and, generally, are designed for severe usage wherein the instrument carried in the belt is covered during use so as to prevent damage.

Additional problems with certain of the prior instrument carrying buckles or belt connected holders have been a difficulty in either quickly and easily removing the watch or other instrument for adjustment or repair or obtaining access to the instrument for minor adjustment. The inability to directly read the instrument without handling or manipulation and yet providing adequate protection for the instrument apparatus, and the inability of providing the above qualities while also providing an aesthetically pleasing, decorative buckle or instrument holder.

SUMMARY OF THE INVENTION

The present invention provides a solution to the above problems and relates to a combination belt buckle having a decorative instrument housing on the face thereof adapted to hold and display a watch, compass or other instrument on the belt of the user. The operative mechanisms of the belt buckle itself are generally conventional and adapted for securement to and to engage the ends of a belt when positioned about the waist of the user.

The invention provides not only the functional purpose of securing the ends of a belt but also holds and displays an instrument such as a watch for direct reading without handling or manipulation. A raised decorative portion formed on the front surface of the buckle provides a chamber to receive, protect and guard the instrument secured therein. The protective portion generally surrounds the instrument and may be attractively decorated with various designs by embossment, engraving, wood burning or the like to complement the instrument carried therein. Means are also provided for removably securing an instrument on the buckle to allow simple, easy removal of the watch for adjustment or repair. Alternately, means providing access to an adjustment mechanism for the instrument are provided so that removal for this purpose is unnecessary.

The combinaton decorative belt buckle and instrument housing includes a generally rectangular base member having generally conventional means formed on a back surface thereof to receive and attach the ends of a belt. A front surface of the rectangular base member is provided with a raised decorative portion surrounding the instrument. An instrument receiving chamber is formed generally in the center of the front surface of he decorative portion.

In one embodiment of the invention, the instrument receiving chamber is defined by wall means which form a part of the decorative surface. An instrument is positioned in the chamber wherein the wall means forms a housing for the instrument and retains the instrument on the buckle. The wall means are configured to allow easy access to any adjustment device for the instrument, such as a watch stem, without removal of the instrument from the buckle.

In another embodiment of the invention, a second member is fixed to the front surface of the buckle and extends outwardly to form the decorative surface. A chamber or cavity formed in the second member is centrally located and is adapted to receive an instrument. Means for securing the instrument is provided in the base member whereby the instrument can be removed from the chamber. In one form, the base member is formed of metallic material such as brass, die case aluminum or the like and the second member is formed of a nonmetallic material as, for example, wood or plastic. The base and the first member may be secured together in any suitable manner as by an adhesive.

The many features and advantages of the present invention over that known in the prior art will, of course, become readily apparent to those skilled in the art upon reading the following specification and with reference to the accompanying drawings.

DETAILED DESCRIPTION OF THE INVENTION

Figure 1:
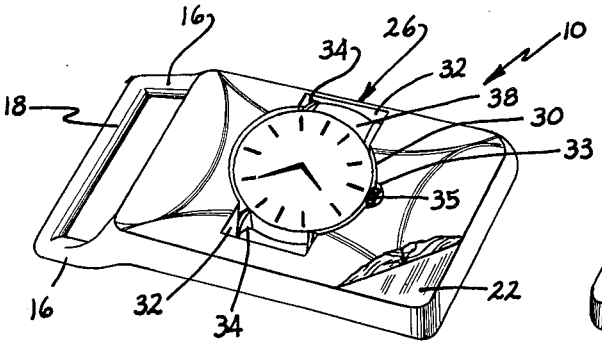
FIG. 1 is a perspective view illustrating a first form of the invention having a time piece secured in the raised decorative face portion.
Figure 2:
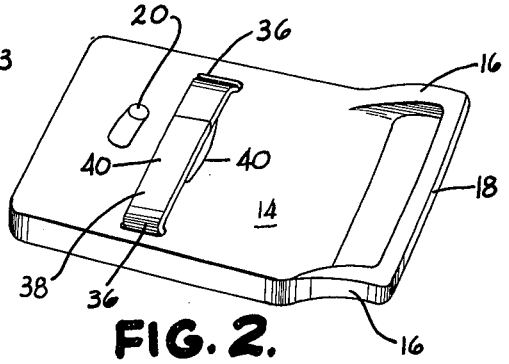
FIG. 2 is a rear view in perspective of the invention as shown in FIG. 1.
Figure 3:
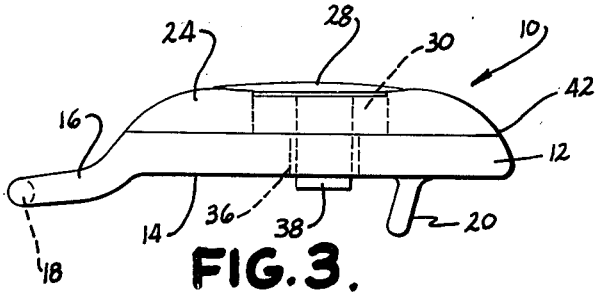
FIG. 3 is an edge view of the decorative belt buckle and instrument housing of the invention shown in FIGS. 1 and 2.

Referring now to the drawings and in particular to FIGS. 1-3, the combination belt buckle and decorative instrument housing will be described in greater detail. The invention, generally designated by the numeral 10, includes a generally rectangular base member 12 having a back surface 14 which includes means to receive and attach the ends of a belt in a generally conventional manner. The receiving and attaching means includes a pair of spaced apart downwardly depending arms 16 connected together by a transverse bar 18 spaced from one side edge of the base 12. One end of the belt is looped over the transverse bar 18 and is secured in a conventional manner. The other end of the buckle is provided with an engagement hook 20 which extends toward bar 18 to engage an aperture in the free end of the belt (not shown) also in a conventional manner.

The front portion of base member 12 opposite the back surface 14 has a generally smooth planar front surface 22 (FIG. 1) upon which a second or decorative member 24 is secured. Preferably, base 12 is formed from a nonmagnetic, metallic material such as die cast alluminum or brass especially where magnetically sensitive instruments are to be included such as watches or compasses. The decorative member, conforming generally in outline configuration to the shape of base 12, extends upwardly and outwardly therefrom to form a decorative surface. In the embodiment illustrated, preferably, the decorative member 24 is formed of wood or the like and is finished to bring out the highlights of the wood grain (not shown) to enhance the overall aesthetic appearance of the finished product.

A chamber 26 is formed in decorative member 24 generally in the central portion thereof and is formed as a recess to receive an instrument as a watch 28. Chamber 26 includes a first central portion or opening 30 and a pair of oppositely extending cutout portions 32. Central portion 30 receives the main body of the intrument while the cutout portions 32 are provided to receive the mounting portions 34 of the watch to which an attachment strap or flexible band 38 is conventionally fixed. A pair of spaced apart openings 36 located directly below cutouts 32 extend through base member 12 from the planar face surface 22 to the back surface 14. The elongated, flexible band member 38 is connected to the mounting portions 34 of the watch and extends through openings 36 where the ends 40 of the flexible band 38 are fastened together at back surface 14 of the base. Preferably, end portions 40 include cooperative Velcro elements fixed thereon whereby, when placed in overlapping relationship, the ends are secured to each other. It will, of course, be recognized that other fasteners as adhesives or snap-type fasteners can be used with equal facility on portions 40. A slight recess or depression 33 may be positioned adjacent the central recessed portion 30 to accommodate and provide access to the winding and setting stem 35 of the watch. Recess 33 is large enough to allow axial extention of the stem for setting as well as winding without such extension.

It will be noted that in the embodiment just described, a smooth flowing transition between metal base member 12 and decorative member 24 occurs at the interface 42 (FIG. 3) between the two members. The side edges of base member 12 and decorative member 24 curve upwardly following generally the same curves or contours to the raised central portion in which the instrument receiving chamber is formed. The curved contour of the raised central portion of member 24 are generally flush with the outermost surface of watch 28, in this case its transparent crystal, so as to surround, guard and protect the watch from impact, contact or snagging on other objects.

Figure 4:
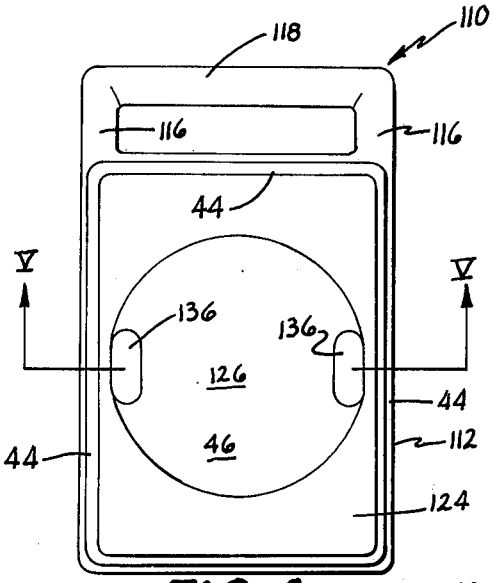
FIG. 4 is a plan view of a somewhat modified form of the invention shown without an instrument secured therein.
Figure 5:
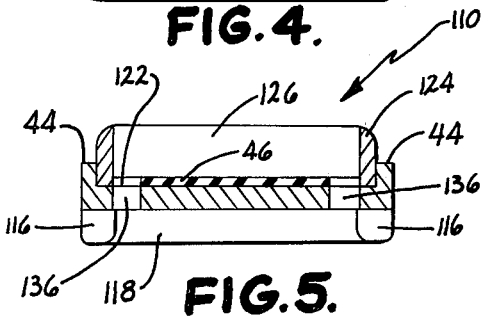
FIG. 5 is a cross sectional view taken along the plane V—V of FIG. 4.

With reference to FIGS. 4 and 5, an alternate embodiment 110 of the invention is illustrated wherein the decorative member is inserted and secured as an inlay in a flat planar recess formed within the base member. Since many of the details are identical to those previously described, corresponding reference numbers bearing the prefix 100 are utilized for illustration and only those portions differing from the previous embodiment are described in detail.

The assembly 110 includes, as in the previous embodiment, a base 112 and a decorative member 124. The planar front surface 122 of the base is formed as a recess such that a peripheral upstanding wall 44 completely surrounds planar surface 122 to receive decorative member 124. As in the previous embodiment, decorative member 124 is secured to the face 122 by means of a suitable adhesive. A pair of spaced openings 136 extending through the base are provided to allow passage of a flexible band or the like attached to an instrument positioned within chamber 126. Chamber 126 is large enough to completely receive a watch or other instrument and is not outlined to the specific instrument configuration as is chamber 26 in embodiment 10. The size of chamber 126 allows easy access to an instrument adjusting mechanism, such as a watch stem, without removal of the instrument. A thin strip of cushioning material 46 as felt, a thin layer of sponge rubber or the like may be positioned at the bottom of recess 126 on the planar face 122 to provide a cushion between the instrument secured in the cavity and the planar surface.

As in the previous embodiment, base 112 is preferably formed of a metallic material and the decorative member 124 is formed of a nonmetallic material as wood, plastic or the like.

Figure 6:
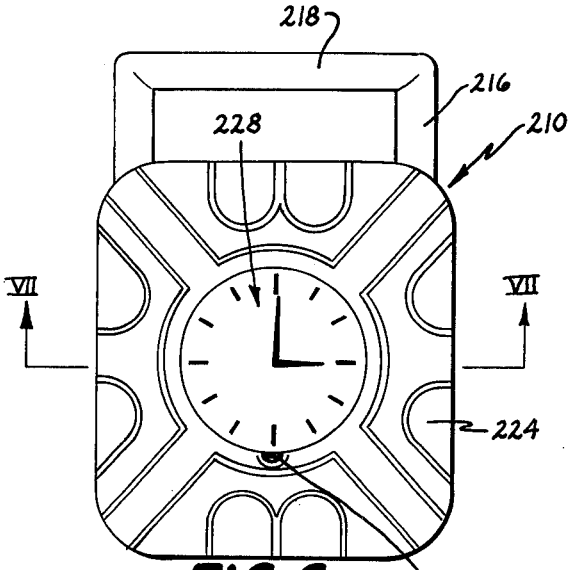
FIG. 6 is a plan view similar to FIG. 4 illustrating yet another embodiment of the invention but including a time piece.
Figure 7:
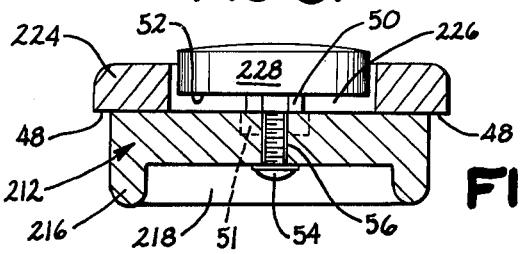
FIG. 7 is a cross sectional view taken along the plane VII—VII of FIG. 6 illustrating additionally a mechanism for securing the time piece within the instrument receiving chambers.

In the embodiment shown in FIGS. 6 and 7 similarly designated by reference numeral bearing the prefix 200, the assembly 210 includes a base member 212 similar to that previously described and a decorative member 224 having a recess in the central portion thereof adapted to receive an instrument 228. In this embodiment, decorative member 224 is slightly larger than base member 212 such that the decorative member overhangs the base along the sides and edges as indicated generally at 48. A somewhat different attachment means for instrument 228 is also illustrated in FIG. 7 wherein a threaded fastening mechanism as a nut 50 is secured to the back surface 52 of the instrument. A screw 54 passed through an opening 56 in base 212 is received by nut 50 to secure the instrument in chamber 226 formed in the decorative member 224. The surface of base 212 may include a small, central recess 51 (shown in phantom in FIG. 7) to receive the height of nut 50 such that the outermost surface of instrument 228 will be flush with the raised portions of member 224 for protection.

Figure 8:
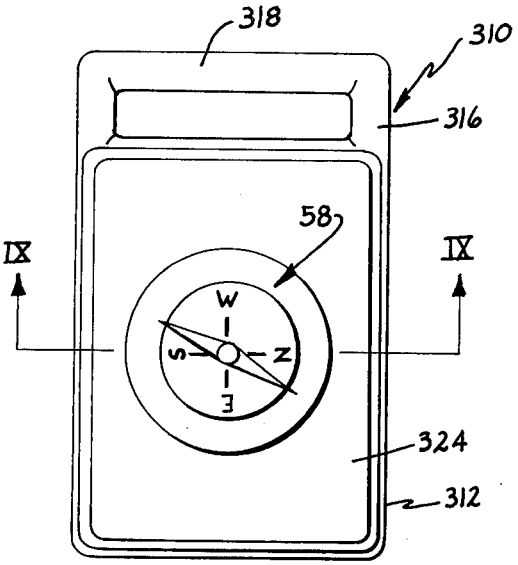
FIG. 8 is a view similar to FIG. 4 and 6 illustrating a compass mounted within the decorative face portion.
Figure 10:
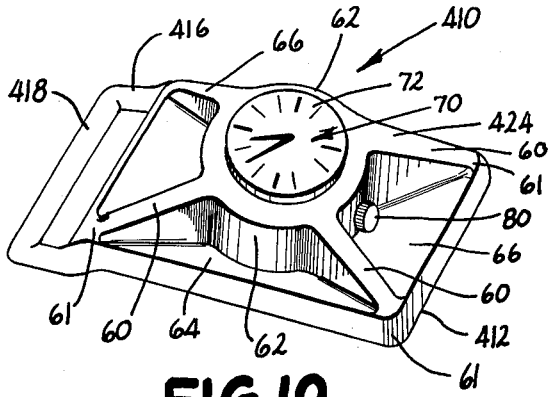
FIG. 10 is a perspective view illustrating an alternate embodiment of the invention wherein the buckle and the decorative portion are integrally formed in one piece.
Figure 9:
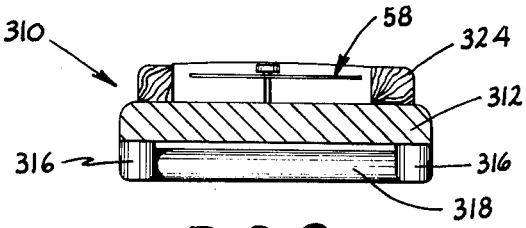
FIG. 9 is a cross sectional view taken along the plane IX—IX of FIG. 8.
Figure 11:
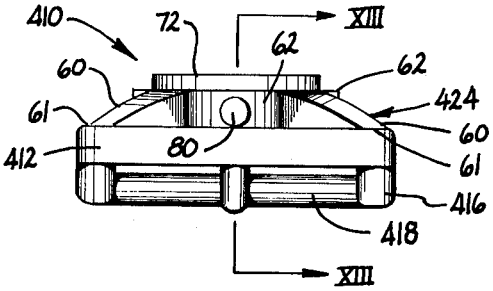
FIG. 11 is an end view of the embodiment shown in FIG. 10.
Figure 12:
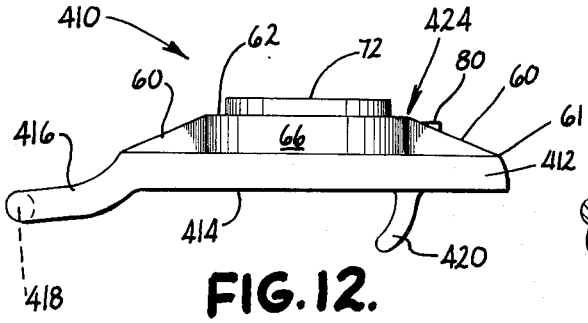
FIG. 12 is a side view of the embodiment of FIGS. 10 and 11.
Figure 13:
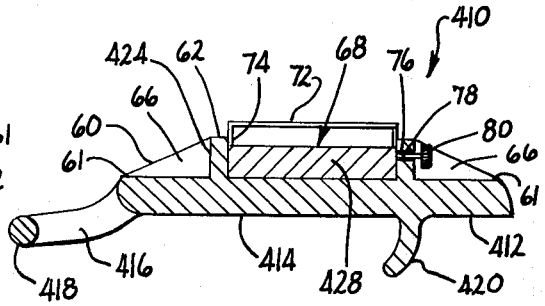
FIG. 13 is a cross sectional view taken along the plane XII—XII of FIG. 11.

FIGS. 8 and 9 illustrate an embodiment 310 of the invention similar to that shown in FIGS. 1-5 wherein the instrument positioned therein comprises a compass 58 seated in a cavity or chamber formed in the decorative member 324. As in the previous embodiment, the decorative member is fixed to base 312 by an adhesive or the like positioned between the base and the decorative member. To secure instrument 58 within the chamber, an adhesive may also be used between the bottom face of the instrument and the planar face 322 of base member 312. In this case the overall size of member 324 is smaller than that of base 312 such that the edges of member 324 are set back or recessed.

An alternate embodiment of the invention is illustrated in FIGS. 10–13 wherein the assembly 410 is formed to include a base 412 and an integral decorative portion 424 formed in one piece with base 412. As in the previous embodiments, base 412 includes a transverse bar 418 and an engagement hook 420 to fix and attach the end of a belt (not shown) in a conventional manner.

In this embodiment, the base and decorative portion 410 are formed as an integral unit and may therefore include basically any desired configuration of the decorative portion. As illustrated, the decorative portion includes a plurality of ribs 60 which taper inwardly and upwardly from the corners 61 of the base toward the center. The ribs are joined at an upstanding annular wall 62 which forms an instrument receiving cavity in the center. The wall 62 both locates and protects an instrument. The side portions 64 and 66 surrounding the annular wall 62 between the corners and ribs are recessed slightly as illustrated to form the decorative appearance. The top surface of the ribs and the annular wall may be polished to enhance the appearance of the metallic material while the recessed portions 64 and 66 may be painted in contrasting colors. Annular wall 62 has a recess 68 machined or otherwise formed therein to form the instrument housing into which the component elements of an instrument as a watch 70 (illustrated), compass or like instrument mechanism may be assembled. A transparent cover or crystal 72 is adapted to cooperate with the inner surfaces 74 of the annular wall such that the crystal can be tightly fit into place. While crystal 72 is shown as protruding above wall 62, it, of course, could be recessed to be flush with the top of the wall for added protection.

An opening 76 is provided through the annular wall 62 to allow passage of the setting or adjustment stem 78 of the instrument. The top portion 80 of the stem extends into the recess 66 for access by the user. Opening 76 and recess 66 thus allow access for adjusting the instrument of watch without removal of the watch from recess 68 although complete removal can be effected from recess 68 by first removing stem 78 if major repairs to the instrument are required. Also, opening 76 helps to locate, position and secure the watch in assembly 410 when the adjusting stem is passed therethrough.

In view of the foregoing description, those skilled in the art will immediately appreciate that many changes and modifications may be made. A watch, compass or even decorative stones, monograms, jewelry, small radios and the like may be positioned within the instrument housing formed generally centrally in the decorative part of the buckle assembly.

Obviously, many modifications and variations of the invention are possible in light of the above teachings and it will be apparent to those skilled in the art that various changes in form and arrangement may be made to suit requirements without departing from the scope of this invention. Accordingly, it is intended that the equivalent arrangements be included unless the following claims by their wording expressly state otherwise.

The embodiments of the invention in which an exclusive property or privilege is claimed are defined as follows:

1. A combination belt buckle and decorative instrument housing comprising:

a first base portion having front and back surfaces and means formed thereon for receiving and attaching the ends of a belt;

a second decorative portion laid over and secured to said front surface of said first portion as a separate member, said second decorative portion being generally coextensive with said front surface of said first base portion and extending away from said front surface of said first portion to form a decorative surface;

a chamber formed in said second decorative portion, said chamber being generally centrally located in said second decorative portion and adapted to receive an instrument from the front of said buckle and housing combination while providing surface areas around said chamber which may be decorated as desired;

means associated with at least one of said first and second portions for securing an instrument in said chamber such that the instrument may be read directly from the exterior of said buckle and housing combination without manipulation or handling, said secnd decorative portion including means for extending around an instrument when secured in said chamber to protect the instrument.

2. The belt buckle and decorative instrument housing of claim 1 wherein said second portion includes recess means forming a space for receiving and allowing access to adjustment means which may be included on an instrument received in said chamber.

3. The belt buckle and decorative instrument housing of claim 1 wherein said front surface of said first portion includes a generally smooth, planar front surface area; said second portion including a separate second member adhered to said planar front surface area.

4. The combination belt buckle and decorative instrument housing of claim 3 wherein said first base portion is formed of metallic material and said second decorative portion is formed of nonmetallic material.

5. The combination belt buckle and decorative instrument housing of claim 4 wherein said first base portion is formed from nonmagnetic material.

6. The combination belt buckle and decorative instrument housing of claim 3 and further including an instrument positioned in said chamber, and wherein said means for securing said instrument includes said first base portion having at least one opening formed therethrough from said planar front surface area to said back surface to allow passage of fastening means, and receiving means secured to said instrument to receive said fastening means whereby said instrument is removably secured in said chamber.

7. The combination belt buckle and decorative instrument housing of claim 3 wherein said generally planar front surface area of said first base portion is bounded by a peripheral upstanding wall means, said planar front surface area being formed as a recess in said front surface, said second decorative portion being positioned in said recess and secured to said planar surface area, said decorative surface thereon extending above said peripheral wall means.

8. A combination belt buckle and decorative instrument housing comprising:

a generally rectangular first base portion having means formed on a back surface thereof adapted to receive and attach the ends of a belt and a second portion extending upwardly therefrom to form a decorative surface;

a chamber formed in said second portion, said chamber being generally centrally located in said second portion and adapted to receive an instrument;

means associated with at least one of said first and second portions for securing an instrument in said chamber such that the instrument may be read directly from the exterior of said buckle and housing combination without manipulation or handling, said second portion adapted to generally extend around an instrument when secured in said chamber to protect the instrument;

said first portion including a generally smooth, planar front surface; said second portion including a separate second member fixed to said planar front surface;

said generally planar front surface of said base member being bounded by a peripheral upstanding wall means, said planar surface being formed as a recess in said front surface, said second member being positioned in said recess and secured to said planar surface, said decorative surface thereon extending above said peripheral wall means;

an instrument positioned in said chamber, cushioning means positioned between said instrument and said planar surface, said securing means including said base member having a pair of spaced apart openings extending therethrough from said planar surface to said back surface, said instrument including an elonagated flexible band member having end portions thereof extending through said openings, and fastening means on said end portions adapted for attachment at said back surface to thereby hold said instrument in said chamber.

9. The combination belt buckle and decorative instrument housing of claim 8 wherein said fastening means on said band include cooperative Velcro elements on said end portions of said band.

10. The combination belt buckle and decorative instrument housing of claim 3 and further including an instrument positioned in said chamber and wherein said fastening means includes said first base portion having at least a pair of spaced openings formed therethrough from said front surface to said back surface, said instrument including an elongated flexible band member having end portions extending through said opening, and fastening means on said end portions adapted for attachment at said back surface to thereby secure said instrument in said chamber.

11. The combination belt buckle and decorative instrument housing of claim 10 wherein said first base portion is formed of metallic material and said second decorative portion is formed of nonmetallic material.

12. The belt buckle and decorative instrument housing of claim 1 wherein said chamber is defined by wall means forming a part of said second decorative portion;

said wall means including receiving means for receiving an adjustment mechanism from an instrument when the instrument is received in said instrument receiving chamber whereby said receiving means allow access to said adjustment mechanism without removal of said intrument from said belt buckle and housing and help locate and position said instrument therein.

13. A combination decorative belt buckle and instrument housing comprising:

a base member having front and back surfaces and means thereon for receiving and attaching the ends of belt;

a raised decorative portion on said front surface of said base member;

an instrument receiving chamber formed in said raised decorative portion and generally centrally located in said front surface, said instrument receiving chamber being defined by wall means forming a part of said decorative surface, opening to said front surface and adapted to receive an instrument therein through said front surface, said wall means extending entirely around the periphery of an instrument such as a watch when received in said chamber and forming a protective case for an instrument into which the component elements of the instrument may be assembled; means on said wall means for receiving a transparent cover for an instrument within said recess to cover and protect the instrument in cooperation with said wall means;

said wall means including receiving means for receiving an adjustment mechanism from an instrument when the instrument is received in said instrument receiving chamber, said receiving means being sufficiently large to allow access to and adjustment of said adjustment mechanism without removal of the instrument from said chamber and without changing the position of the instrument on said belt buckle and housing while protecting the instrument, said receiving means including means for locating and positioning the instrument therein, a portion of said wall means extending beyond the end of any instrument adjustment mechanism when an instrument is mounted in said receiving means.

14. The decorative belt buckle and instrument housing of claim 13 wherein said base member including said back surface and said decorative portion on said front surface are integrally formed of metallic material.

15. The decorative belt buckle and instrument housing of claim 13 including:

an instrument positioned in said chamber, said wall means forming a housing for said instrument and retaining said instrument in said buckle;

said instrument including a stem portion for adjustment of said instrument, said wall means including an opening formed therethrough, having a closed periphery, and being generally parallel to said back surface, said stem portion extending through said opening formed in said wall means and into said decorative portion for access thereto.

16. The decorative belt buckle and instrument housing of claim 15 wherein said decorative portion includes a recessed area around said stem portion on the outside surface of said wall means where it extends through said opening on the exterior of said wall means to provide access to said stem for adjustment while protecting said stem.

17. An article of manufacture comprising:

a metallic base member having a first surface adapted to receive and engage the ends of a belt and a second surface adapted to receive an inlay;

a nonmetallic inlay member having a rear surface adapted for engagement with said second surface of said base member, said inlay having a decorative front surface;

an instrument receiving chamber formed in said front surface of said inlay, said chamber adapted to receive an instrument such as a time piece therein such that the face of the instrument is visible without moving the instrument, said chamber extending around the instrument when fitted therein to protect the instrument;

means for securing said inlay in a fixed position relative to said base with said decorative surface being exposed to view, said inlay being generally coextensive with said second surface of said metallic base member with said decorative surface extending around said chamber; and means formed in said base for securing said instrument in said chamber.

18. The article of manufacture of claim 25 wherein said second surface of said base member is bounded by a peripheral upstanding wall means, said surface being formed as a recess in said base member, said inlay member being positioned in said recess and secured to said second surface, said decorative front surface extending above said peripheral wall means.

* * * * *

UNITED STATES PATENT AND TRADEMARK OFFICE

CERTIFICATE OF CORRECTION

PATENT NO. : 4,053,966

DATED : October 18, 1977

INVENTOR(S) : LAWRENCE A. DIELEMAN

It is certified that error appears in the above-identified patent and that said Letters Patent are hereby corrected as shown below:

Column 1, Line 26,

"in" should be --on--.

Column 2, Line 6,

"he" should be --the--.

Column 2, Line 56,

"chambers" should be --chamber--.

Column 3, Line 27,

"alluminum" should be --aluminum--.

Column 3, Line 42,

"intrument" should be --instrument--.

Column 6, Line 28,

"secnd" should be --second--.

Column 7, Line 66,

"intrument" should be --instrument--.

UNITED STATES PATENT AND TRADEMARK OFFICE

CERTIFICATE OF CORRECTION

PATENT NO. : 4,053,966

DATED : October 18, 1977

INVENTOR(S) : LAWRENCE A. DIELEMAN

It is certified that error appears in the above-identified patent and that said Letters Patent are hereby corrected as shown below:

Column 8, Line 5,

"of belt" should be --of a belt--.

Column 10, Line 5,

"25" should be --17--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*